US005465428A

United States Patent [19]

Earl

[11] Patent Number: 5,465,428

[45] Date of Patent: Nov. 14, 1995

[54] EXERCISE DEVICE OF ADJUSTABLE RESISTANCE FOR FLEXING OF MUSCLES OF THE LEGS AND TORSO

[76] Inventor: Michael S. Earl, 5010 Rosamond Dr., Apt. 2413, Orlando, Fla. 33808

[21] Appl. No.: 98,716

[22] Filed: Jul. 29, 1993

[51] Int. Cl.[6] ..... A63B 21/02; A41D 1/08

[52] U.S. Cl. ..... 2/238; 2/227; 2/228; 482/124

[58] Field of Search ..... 2/22, 69, 227, 2/228, 238, 23, 233, 313, 319, 321; 482/74, 121, 122, 124; 601/23, 34, 35

[56] References Cited

U.S. PATENT DOCUMENTS

| | | | |
|---|---|---|---|
| 1,194,884 | 8/1916 | Sandow | 482/124 |
| 1,337,901 | 4/1920 | Godward | 2/233 |
| 1,663,641 | 3/1928 | Smallwood | 482/124 |
| 1,698,273 | 2/1927 | Davidson | 482/124 |
| 2,097,376 | 10/1937 | Marshman | 482/124 |
| 2,431,811 | 12/1947 | Lang | 2/117 |
| 3,162,442 | 12/1964 | Karlik | 482/124 |
| 3,295,517 | 1/1967 | Stevens | 2/22 |
| 4,065,814 | 1/1978 | Fox | 2/79 |
| 4,606,542 | 8/1986 | Segal | 482/124 |
| 4,910,802 | 3/1990 | Malloy | 482/124 |
| 4,955,608 | 9/1990 | Dougherty et al. | 482/124 |
| 4,961,573 | 10/1990 | Wehrell | 482/121 |
| 5,033,117 | 7/1991 | Fairweather | 2/227 |
| 5,042,799 | 8/1991 | Stanley | 272/138 |
| 5,075,902 | 12/1991 | McReynolds et al. | 2/238 |
| 5,176,600 | 1/1993 | Wilkinson | 482/122 |
| 5,201,074 | 4/1993 | Dicker | 2/228 |
| 5,203,754 | 4/1993 | Maclean | 482/121 |
| 5,267,928 | 12/1993 | Barik et al. | 482/124 |
| 5,308,305 | 5/1994 | Romney | 2/69 |

FOREIGN PATENT DOCUMENTS

| | | | |
|---|---|---|---|
| 0018341 | of 1908 | United Kingdom | 482/124 |

OTHER PUBLICATIONS

Gershman, Maurice. "Self Adhering Nylon Tapes", *Journal of AMA*, vol. 168, No. 7, Oct. 18, 1958.

*Primary Examiner*—C. D. Crowder
*Assistant Examiner*—Amy B. Vanatta
*Attorney, Agent, or Firm*—Julian C. Renfro

[57] ABSTRACT

An elasticized garment intended to provide exercise to the upper legs, hips, buttocks and abdominal muscles of a wearer, the garment being generally in an inverted, U-shaped configuration. An upper portion of the elasticized garment is intended to be attached to a rear waist portion of the wearer, to which upper portion, the upper ends of a pair of elongate, elasticized descending members are firmly attached. The lower end of each of the elasticized descending members has an attachment arrangement permitting attachment on the rear side of an upper leg portion of the wearer, with these elasticized descending members thus serving to resist to a desirable degree, the wearer's forward leg motion. I preferably utilize a pair of thigh-encircling members, to which the lower ends of the elasticized descending members may readily and removably attach. In this way, the wearer can derive a desired amount of exercise during walking or running. Should the wearer so desire, my novel garment can be worn directly over street clothes, and the lower ends of the descending members can be readily detached from the thigh-encircling members, should at any point the wearer wish to discontinue the exercise effort.

23 Claims, 2 Drawing Sheets

EXERCISE DEVICE OF ADJUSTABLE RESISTANCE FOR FLEXING OF MUSCLES OF THE LEGS AND TORSO

BACKGROUND OF THE INVENTION

The prior art is replete with devices designed to be worn on the human body in order to create muscle tone, muscle strength and to provide good exercise for the wearer.

One example of a device of this general type is the Fox U.S. Pat. 4,065,814 entitled "One Piece Elastic Body Suit," which is a one-piece suit worn by a person for the purpose of coordinating and toning the body. This patentee's suit covers the arms, legs and torso of the wearer, and involves an outer and inner cloth layer joined together. A plurality of elastic band members are disposed between the inner and outer layers of the suit, with the suit being "adapted to tone and strengthen the body movement and coordination of a person by the application of a positive pressure to the legs, back and shoulders of the person."

Somewhat similar is the Malloy U.S. Pat. No. 4,910,802 entitled "Exercise Suit" which is a suit of unitary construction utilizing a plurality of elastic bands associated with each human appendage. That patentee makes clear that his suit is configured and arranged for covering a major portion of the human exterior, being provided with adjustable tension means for varying the degree of exercise to be effected.

The Dougherty et al U.S. Pat. No. 4,955,608 entitled "Athletic Movement Trainer" utilizes an elasticized, bungee-type cord passing through a ring attached to the wearer's belt, with each end of the cord adjustably attached to an ankle strap. These patentees explain that the cord will remain relaxed as long as the sportsman maintains the proper athletic position, but will become tensioned when the athlete deviates from the correct posture or stance.

It was to improve upon devices of the foregoing type that the present exercise device was created for enabling a wearer to provide proper exercise for the muscles of his or her legs and torso, without requiring the wearing of a full length suit.

SUMMARY OF THE INVENTION

As will be seen in greater detail hereinafter, the present invention involves an elasticized garment intended to provide exercise to the upper legs, hips, buttocks and abdominal muscles of a wearer. The preferred embodiment of this garment is generally of an inverted, U-shaped configuration, with an upper portion of this elasticized garment to be attached to a rear waist portion of the wearer. To this upper portion, the upper ends of a pair of elasticized descending members are firmly attached, with the lower end of each of the elasticized descending members having attachment means for attachment on the rear side of an upper leg portion of the wearer. It is to be understood that the elasticized descending members serve to resist the wearer's forward leg motion to a selected degree, and thus provide a desired amount of exercise to the wearer during walking or running.

The elasticized garment in accordance with this invention preferably utilizes elasticized descending members in the form of a plurality of wide elastic sheets designed when in use to reside against the buttocks of the wearer, and provide substantial exercise thereto.

In the preferred embodiment, the elasticized garment is utilized in combination with a waist-encircling member, which waist-encircling member has a rear waist portion, with the upper portion of the elasticized garment having means for ready attachment to the rear waist portion of the waist-encircling member. Advantageously, I may utilize hook and loop strips or hook and loop fasteners, such as VELCRO as a means for removably attaching the upper portion of this elasticized garment to the rear waist portion, and to upper leg portions of the wearer.

In the preferred embodiment, a plurality of locations are defined on the rear waist portion, for receiving the upper portion of the elasticized garment, thus providing a means for determining the degree of stretch of the elasticized descending members during use by the wearer.

The elasticized garment in accordance with this invention is preferably utilized in combination with a pair of leg-encircling members, which the wearer may attach around his lower thighs, just above the knee. Each of the leg-encircling members has attachment means thereon, for removably receiving the lower ends of the elasticized descending members. A plurality of attachment locations are provided on the leg-encircling members, in the interests of adjustability.

The present invention may be regarded as a multicomponent device involving a waist-encircling member having tightening means such that it can be worn tightly around the waist of the wearer in a substantially non-slip fashion, which is used in combination with a pair of members utilized to encircle the upper leg portions of the wearer, with latter members preferably being referred to as thigh-encircling members. Each of these thigh-encircling members has its respective tightening means.

The previously-described elasticized garment serves to interconnect the waist-encircling member with the respective thigh-encircling members, with this elastic garment having an upper portion that preferably is removably attached to a rear portion of the waist-encircling member, as well as having a separated pair of lower portions, with each of these lower portions preferably being removably affixed to a respective thigh-encircling member. Alternatively, I may utilize a type of unitary construction.

Each elastic member may involve a series of elastic straps of 4" to 5" width, with a lower portion of each of such members having attachment means that, as previously mentioned, are preferably removably attached to the thigh-encircling members. These wide elastic members I utilize as the elastic interconnection means are in the nature of elastic sheet members, with it being the intent of each of these wide elastic members to provide a strong upward pull on the rearward parts of the respective thigh-encircling member, and a downward pull on the rearward part of the waist-encircling member, thereby creating a tug-of-war effect with the thigh muscles at one end and the abdominal and lower back muscles at the other.

My novel garment provides a number of advantageous features, among which is the bringing about of a thorough exercise of the quadricep muscles of the legs, hips, the abdominals and the lower back. Because these wide sheets of elastic material are intended to be situated relative to each other in such a way as to cover a majority of the surface area of the buttocks of the user or wearer, my novel elastic interconnection means also serves to directly exercise the buttocks by creating a downward push on the buttock surface area.

More particularly, the act of walking or running requires the muscles of the buttocks to flex. Therefore the buttocks are further exercised as the elastic sheet members covering the buttocks exert a downward force against the flexed buttocks with each step taken. This forces the already-flexed buttocks to flex even more.

My novel multicomponent device was originally intended to be utilized while walking, so as to provide the user or wearer a pleasant way of bringing about muscle building and toning benefits, without requiring strenuous exercise to be undertaken. I thereafter discovered, however, that my multicomponent device could be utilized quite well while running, and inasmuch as running typically requires the user or wearer to bring the thigh to a greater angle relative to the body's vertical plane than does walking, the runner experiences more resistance per stride than does the walker.

In essence, the members representing my novel multicomponent device create what may be regarded as a "tug of war" effort, with the abdominal muscles being involved at one end, and the thigh muscles at the other end, with it to be realized that the elastic sheet material may be regarded as representing the "rope" of the tug of war effort.

It is thus to be seen that my novel device simultaneously exercises the muscles of the thighs, hips, buttocks, abdomen and lower back while at the same time providing support for the lower back and promoting good, erect posture.

One particularly noteworthy aspect of my invention is the fact that by the elastic interconnection means being affixed to the thigh-encircling members, the placing of any extra stress on the knees of the wearer is carefully avoided. In other words, by virtue of the highly advantageous arrangement I am providing, the thighs may be exercised from movement originating in the hips rather than the knee. Persons with one or more amputated lower limbs, as well as persons with bad or injured knees will find the instant device to be particularly beneficial in obtaining very helpful yet carefully localized exercise.

The present invention is of particular benefit to its owner because the resistance created by the stretching of the lower portions of the elastic interconnection means may be adjusted to meet the user's personal fitness needs. This adjustable resistance feature is possible because I use hook and loop strips or hook and loop fasteners, such as VELCRO to attach the lower portions of the elastic interconnection member to the rearward areas of each respective thigh-encircling member. Using this arrangement, the user may easily attach the lower portions of the elastic interconnection member to different locations on the rearward areas of the thigh-encircling members, resulting in a greater or lesser stretching, and hence resistance. Moreover, this highly desirable arrangement allows the user to make such an adjustment without having to remove either the waist-encircling member or the thigh-encircling members. Indeed, adjustments of this sort may be made during use, in mere seconds.

It is therefore to be seen that a primary object of the present invention is to provide an easily affordable device readily anchored between the user's waist and thighs, that in a highly effective manner provides a desirable amount of resistance, thus to bring about proper exercise and good muscle tone while the user is walking, running or engaging in other athletic activities.

It is another object of this invention to provide a device of economical and compact construction that can be painlessly utilized for exercising the muscles of the abdomen, hips, lower back and quadriceps, by creating a resistance oriented perpendicular to the spine. This perpendicular resistance may be compared to the resistance gravity creates against the upper body of a person performing a sit-up.

It is still another object of this invention to provide a device enabling a person to engage in and enjoy exercise that offers both aerobic and strength training benefits without the boredom typically associated with stationary exercise machines.

It is yet another object of this invention to provide a device enabling a person with insufficient time to pursue an exercise regimen, the opportunity to obtain a desirable amount of exercise while walking, jogging or running from one location to another, without requiring the person to wear a full length exercise suit.

It is yet still object of this invention to provide an exercise device that creates muscle exercising and toning resistance without employing the use of heavy, burdensome weights. Because my invention employs elastic materials to create resistance, my invention may be used in zero-gravity environments such as outer space.

It is yet another object of this invention to provide a lightweight and unobtrusive strength-training device that a competitive athlete can use during the practice of his or her sport. The present invention affords the athlete a means of applying resistance to the exact movements involved in the performance of a particular athletic activity. This has many advantages over applying resistance to simulated movements in accordance with prior art techniques as may involve the use of free weights and machines.

It is yet still another object of this invention to provide a device that delivers a resistance that may easily be adjusted to meet the fitness demands of the user or wearer, and quite advantageously, my novel design allows the user or wearer to make this adjustment during use, with a minimum amount of time and effort.

It is another object of the present invention to provide a golfer with a device to aid him or her in the development of a proper golf swing, this being particularly possible inasmuch as the two wide elastic lower portions of the elastic interconnection means may be engaged separately to a respective thigh-encircling member. With my invention the right-handed golfer, by engaging the right side lower portion of the elastic interconnection means only, can create a tension against the right buttock and hip that can only be relieved by turning the hips to face the ball's line of flight. The process is simply reversed for the left-handed golfer. Given that the rotation of the hips is a fundamental element of a proper golf swing my invention will provide a valuable tool to golfers at all levels of experience.

It is yet another object of this invention to provide an exercise device usable in a number of different fitness settings, to enable a very effective exercise of certain portions of the body while the wearer is walking, running, swimming, playing tennis, utilizing step machines or the like, as well as when the wearer is performing chores around the house, shopping or sightseeing.

These and other objects, features and advantages will be more apparent from a study of the enclosed text and the appended drawings.

DETAILED DESCRIPTION

Figure 1:
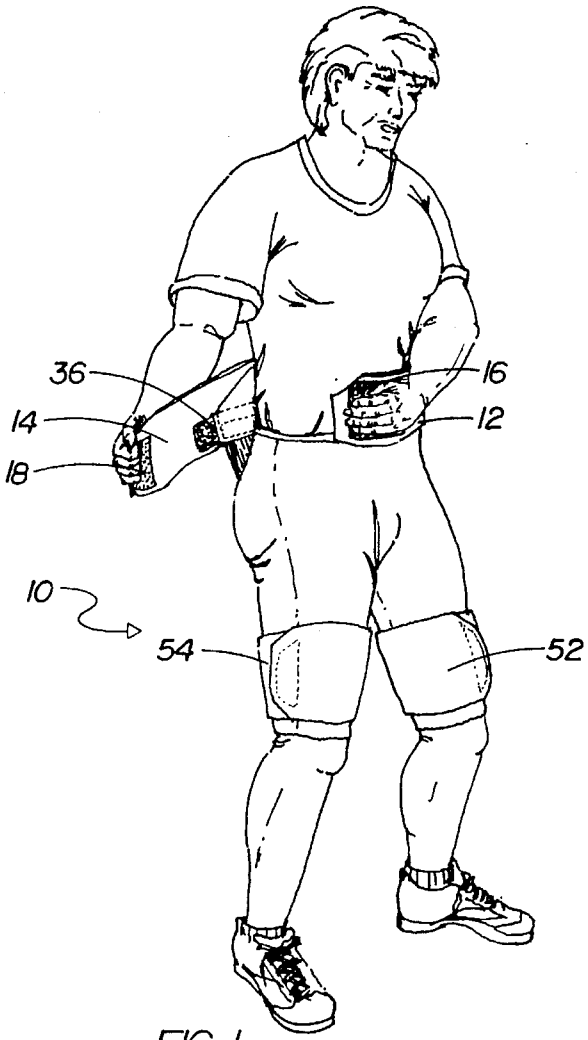
FIG. 1 is a front view of a person wearing certain portions of my novel exercise device, with the waist-encircling member shown in a partially open position in the interests of clarity and in order to reveal certain detail.

With initial reference to FIG. 1, it will be seen that I have depicted a multicomponent device 10 designed to provide exercise to the upper legs, hips, buttocks and abdominal muscles of a wearer or user. It is to be understood that my multicomponent device 10 comprises a waist-encircling member 12, an elasticized portion 40 generally of an inverted, U-shaped configuration, and a pair of thigh-encircling members 52 and 54.

Figure 3:
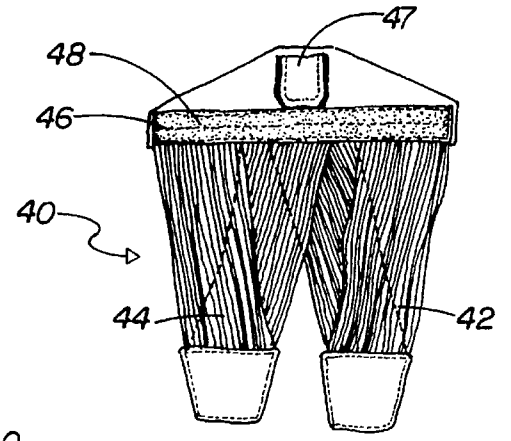
FIG. 3 is a view from the rear side showing my novel elasticized garment removed from the waist-encircling and the thigh-encircling members, looking in a forward direction so as to reveal the use of hook and loop strips or hook and loop fasteners, such as VELCRO in order that the upper portion of my elasticized garment can be readily attached to the waist-encircling portion of my exercise device.

As will be observed from several of the figures, but best in FIG. 3, an upper portion 46 of the elasticized portion or garment 40 is intended to be attached to a rear waist portion of the wearer, with the upper ends of a pair of elasticized descending members 42 and 44 being firmly attached to this upper portion 46 of the elasticized garment 40. It is also to be noted that the lower end of each of the elasticized descending members 42 and 44 have attachment means for attachment on the rear side of a respective upper leg portion of the wearer. As is obvious, the elasticized descending members 42 and 44 serve to resist the wearer's forward leg motion at such time as they have been attached to the wearer's waist portion and to the thigh-encircling members 52 and 54 placed just above the knee, and thus provide a desired amount of exercise to the wearer during walking or running.

With continuing reference to FIG. 1, it is to be understood that the waist-encircling member 12 is designed to be worn tightly around the waist of the wearer or user in a substantially non-slip fashion, with this member being shown in this instance in a partially opened position.

Figure 4:
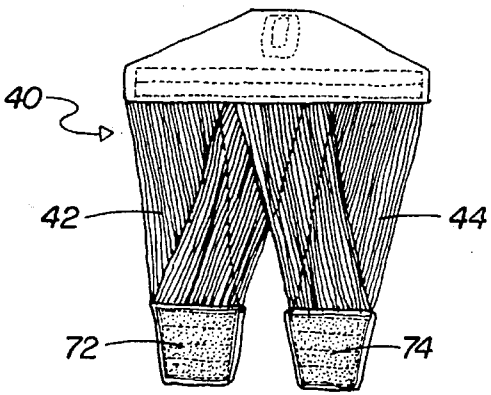
FIG. 4 is a view generally along the lines of FIG. 3, but instead showing my novel elasticized garment as viewed from the front side, while looking rearwardly.
Figure 2:
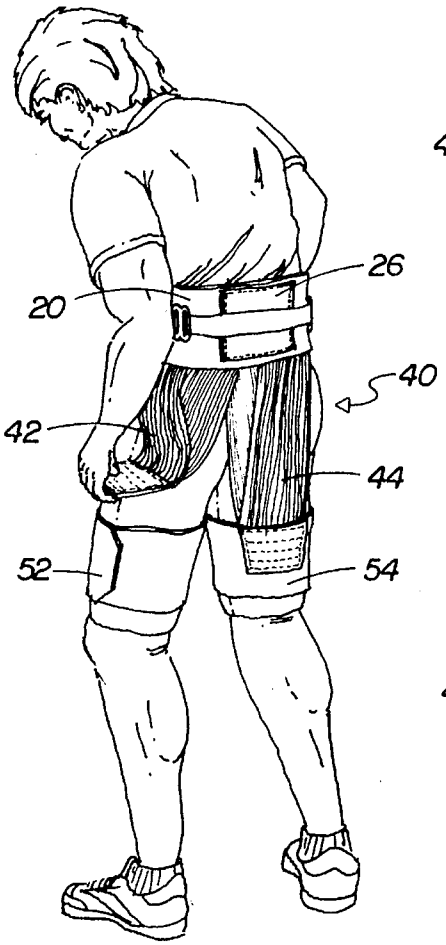
FIG. 2 is a rear perspective view from the left side of a person wearing my novel elasticized garment, with this view revealing one of the elasticized descending members attached in approximately its operative position on the right leg of the wearer.

It is important to note that the waist-encircling member 12 is designed for use in conjunction with the above-described novel elasticized garment or interconnection means 40, best seen in the deployed position in FIG. 2, and by itself in FIGS. 3 and 4. It is to be understood that the elasticized member 40 is arranged to be removably installed at a rear location on the waist-encircling encircling member 12, so as to enable the user or wearer to go about obtaining a desired form of exercise.

As seen in FIGS. 2 through 4, the elasticized descending members 42 and 44 are securely attached to a waist portion 46, with the lowermost ends of the portions 42 and 44 being provided with means 72 and 74 enabling them to be removably affixed to the separate thigh-encircling members 52 and 54.

As best seen in FIG. 3, wherein the elasticized garment or interconnection means 40 is viewed from behind while looking forwardly, the upper edge or waist portion 46 of the elastic interconnection means 40 is equipped with a laterally extending length of a hook type fastener, such as hook-type VELCRO 48, to facilitate the attachment of the elasticized garment 40 in a particular manner to a selected rear portion of the waist-encircling member 12. I prefer to attach the upper portion of the elasticized garment or interconnection means 40 to the interior side of the rear of the waist-encircling member 12, but I am not to be limited to this. It is to be noted that I build up (i.e., make thicker) the elasticized garment 40 at the location of its upper portion by securing to the upper portion of the elasticized garment 40, a small (e.g., 2"×2"×¼"), square piece of neoprene sheet rubber 47 at a location just above the lateral midpoint of the upper edge of the laterally extending length of hook-type VELCRO 48. The built up portion helps keep the upper most portion of the elasticized garment 40 in firm contact against the user's lower back during use, thus providing the user greater back support and comfort than would be achieved without this built up area. More details of the elasticized garment 40 will be discussed hereinafter.

From FIG. 1 it can be seen that the waist-encircling member 12 is of elongate construction, preferably having an interior surface 14 that is essentially smooth, but carrying a length of loop-type VELCRO 36, that is designed to interact with the aforementioned length of hook-type VELCRO 48 utilized, as depicted in FIG. 3, upon the upper edge or waist portion 46 of the elasticized garment 40. The essentially smooth interior surface 14 of the member 12 is to be brought into comfortable contact with the clothing worn around the waist portion of the wearer.

Figure 5:
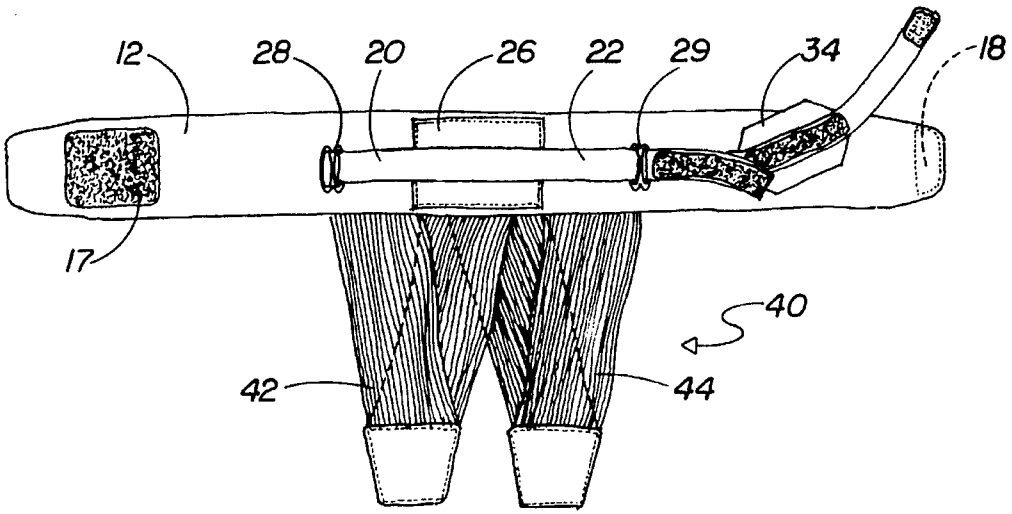
FIG. 5 is a view from the rear of my novel elasticized garment utilized in conjunction with a waist-encircling member laid out to its full length to reveal the exterior of such waist-encircling member, with this figure also illustrating the location of the novel elasticized garment whose upper edge is removably attached to an interior portion of the waist-encircling member.
Figure 6:
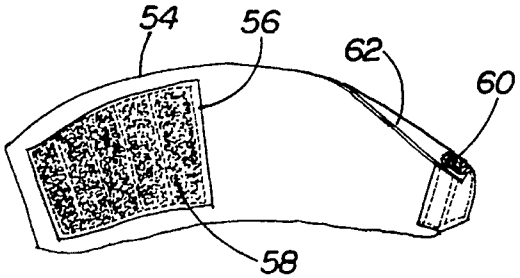
FIG. 6 is a view of one of a pair of similarly-configured devices designed to encircle the thighs of a user, with it to be understood that the lower end of one of the elasticized descending members is readily attachable to the respective thigh-encircling member.

On the other hand, the waist-encircling member 12 has an exterior surface 16 of such a nature that it can readily be used with hook-type VELCRO; note FIGS. 1 and 5. It is thus to be seen from these figures that the exterior surface 16 of the waist-encircling member 12 preferably possesses the characteristics of loop-type VELCRO, such that the fastening of the waist-encircling member about the waist of the user in a relatively tight manner can be readily accomplished for a variety of different people, involving a wide range of waist sizes. By the same token, this end may also be accomplished by sewing or otherwise securing a patch of loop-type VELCRO 17 to waist-encircling member 12 at an area of said member 12 where fastening will take place. This patch of loop-type VELCRO 17 is clearly seen in FIG. 5. To be of particular help in fastening the waist-encircling member, I utilize a patch or piece of hook-type VELCRO at location 18 on the interior portion of the waist-encircling member 12, as is clearly visible in FIG. 1.

Material of the type I prefer to use in the construction of the waist-encircling member 12 is commercially available from Rubatex of Bedford, Va., and many sports-minded people are quite familiar with this type of material, for it is frequently used in the construction of the wetsuits utilized by scuba divers.

As should now be obvious, the waist-encircling member 12 is designed to be of sufficient length to go around the waist of the user, and then be overlapped to a desirable extent, with the aforementioned patch or piece 18 of hook-type VELCRO on the inner side of the overlapped end of this member enabling the waist-encircling member 12 to fit in a desirably close-fitting manner around the waist of the user. Because of the aforementioned preference for the waist-encircling member to be made of wetsuit material, the hook-type VELCRO utilized in the construction of the patch 18 on the inner side of the overlapped portion of the waist-encircling member 12 can be readily secured at any of a wide number of different locations on the exterior surface 16 of the member 12, with the particular location in a given instance being appropriate to the particular wearer or user.

As will be seen hereinafter, other members of hook-type VELCRO are also to be attached at selected locations to the exterior surface 16 of the waist-encircling member 12.

One particular further component worn on the exterior of the waist-encircling member 12 is an additional means for assuring that the member 12 can be worn in a particularly tight manner around the waist of the wearer, or in other words, in a substantially non-slip fashion. To this end, I provide a flat strap member 20 of sturdy construction, that is of a length greater than that necessary for passage around the waist. As viewed in FIG. 5, the strap member 20 is of lesser width than the width of the member 12, and the member 20 can be of webbed nylon of a type similar to that used for seatbelts for automobiles, although I am not to be limited to this.

Figure 7:
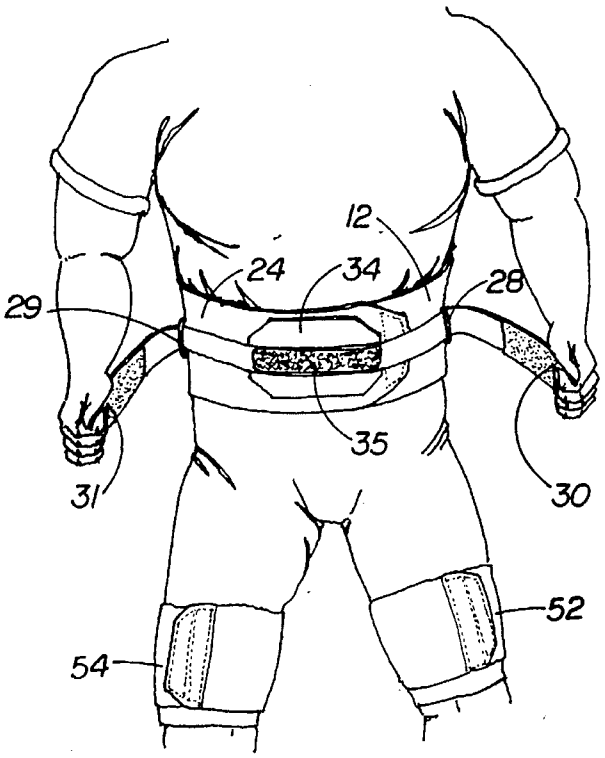
FIG. 7 is a view showing the waist-encircling member I prefer to use with my elasticized garment, with the user in this instance pulling upon a strap member that may be used with the waist-encircling member in order to cause the waist-encircling member to tightly engage the waist of the user, with this view also revealing the hook and loop strips or hook and loop fasteners, such as VELCRO that may be utilized on the front of the waist-encircling member.

A rear portion 22 of the strap member 20 is sewn or otherwise tightly affixed to a rear exterior surface of the waist-encircling member 12, this being visible in FIGS. 2 and 5. Somewhat in contrast with this, a front portion 24 of the strap member 20, best seen in FIG. 7, is not directly affixed to the member 12, for reasons shortly to be explained.

With continuing reference to FIGS. 2 and 5, it will be seen that I prefer to sew or otherwise secure a comparatively large rectangular member 26 to the exterior rear portion of the waist-encircling member 12, which serves the purpose of preventing "rollover" or any other form of distortion of the rear portion of the member 12 when the waist-encircling member is being utilized around the waist of the user. As is obvious, the rectangular member 26 is affixed in such a manner as to substantially coincide with the spinal area of the user, and thus is positioned so as to provide support for the user's lower back.

As should be obvious, the waist-encircling member 12 is subjected to a downward pull of substantial force as a result of the action of the elasticized garment or interconnection means 40 when this garment is removably attached to the waist-encircling member 12 as well as to both of the thigh-encircling members 52 and 54. In FIG. 3, a view looking forward from the rear side of the elastic interconnection member 40, illustrates the use of VELCRO 48 on the upper edge or waist portion 46 of the member 40, whereas in FIG. 4, a view looking rearward from the front side of the member 40, I illustrate other details of the elasticized garment 40.

The novel elasticized garment or interconnection means 40 I provide in accordance with this invention preferably involves a pair of wide elastic members 42 and 44 that are to be removably attached to the interior rear portion 36 of the waist-encircling member 12. Each wide elastic member may involve a series of elastic straps of 4" to 5" width, with the upper ends of such straps sewn or otherwise secured to the upper edge or waist portion 46 of the elastic interconnection means 40, and a lower portion of each of such members or straps utilizing attachment means or members 72 and 74 upon which hook-type VELCRO is preferably used. The use of VELCRO on the members 72 and 74 is of course to enable each of the lowermost ends of the descending members 42 and 44 to be removably attached to a respective thigh-encircling member. These wide elastic members I utilize as the elastic components of my elasticized garment 40 are in the nature of elastic sheet members, with it being the intent of each of these wide elastic members to provide a strong upward pull on the rearward parts of the respective thigh-encircling member, and a downward pull on the rearward part of the waist-encircling member. This arrangement therefore sets up what may be regarded as a tug-of-war effect with the thigh muscles at one end and the abdominal and lower back muscles at the other.

My invention can be regarded as an adjustable resistance exercise device inasmuch as the user may easily attach the hook-type VELCRO 48 of the elastic interconnection means 40 to a selected location on the loop-type VELCRO 36 provided on the interior of waist-encircling member 12. Even more adjustability, however, may be obtained by making it possible for the user to attach the hook-type VELCRO on lower members 72 and 74 to selected locations on the rearward areas of the respective thigh-encircling members 52 and 54. Depending on the attachment locations utilized, a lesser amount or a greater amount of stretching of the lower elasticized portions 42 and 44 is brought about, hence providing adjustability with regard to the resistance provided.

As should now be quite apparent to those skilled in the art, by changing the amount of stretch in the elastic members 42 and 44, a change in the amount of resistance is necessarily brought about. Moreover, this highly desirable arrangement allows the user to make such an adjustment without having to remove either the waist-encircling member or the thigh-encircling members. Indeed, adjustments of this sort may be made during use, in mere seconds.

The use of my novel elasticized garment 40 provides a number of advantageous features, among which is the bringing about of a thorough exercise of the quadricep muscles of the legs, the hips, the abdominals and the lower back. Because these wide sheets of elastic material are intended to be situated relative to each other in such a way as when worn, to cover a majority of the surface area of the user's buttocks, my novel elasticized garment 40 also serves to directly exercise the buttocks by creating a downward push on the buttock surface area.

As mentioned above, I may utilize stitching or the like for securing the upper ends of the wide elastic material utilized in the construction of the lower portions 42 and 44 to the waist band portion 46 of the elastic interconnection means 40. Other details include the utilization of the attachment components 72 and 74 utilizing hook-type VELCRO at the lowermost ends of the elasticized descending members or means 42 and 44. The hook-type VELCRO used on attachment components 72 and 74 is thus disposed in a position such that it can be readily attached to the loop-type VELCRO utilized on the thigh-encircling members 52 and 54.

With particular reference now to FIG. 5, it will be seen from this figure that the waist-encircling member 12 has been laid out in its full length position, thus to display details on its exterior portion, including the comparatively large, relative stiff member 26 of generally rectangular configuration that is firmly attached to the rear outer side of the waist-encircling member 12.

The rectangular member 26 is ideally constructed of comparatively thick leather sewn tightly to the central rear portion of the waist-encircling member 12, such that the member 26 substantially coincides with the spinal area of the wearer. I am not, however, to be limited to this construction, for obviously a firm piece of plastic can be substituted in place of a member 26 of leather, and the member 26 could be glued, riveted or otherwise secured to the outer surface of the member 12 should such be preferred in place of stitches.

I prefer for the rear portion 22 of the strap member 20 to be sewn or otherwise secured across a mid portion of the comparatively large rectangular member 26 located on the backside of the waist-encircling member 12. Although I am not to be limited to the use of buckles on the rear portion 22 of the strap member 20, in accordance with a preferred embodiment, I firmly attach, as shown in FIG. 5, a buckle member 28 on one end of the rear portion 22 of the strap member 20, and a buckle member 29 on the other end of the rear portion of the strap member 20. This arrangement is particularly effective in enabling the user to selectively bring the principal portion of the strap member 20 into a condition of considerable tightness around the waist of the wearer.

With reference now to FIG. 7, it is to be seen that the front portion 24 of the strap member 20 has free ends 30 and 31 designed to be readily inserted into the buckle members 28 and 29, respectively, that are affixed to the ends of the rear portion 22 of the strap member 20. A front portion 24 of the strap member 20 is firmly attached to a relatively stiff member 34 that is designed to reside in the front center portion of the waist area of the wearer or user. The relatively stiff member 34 is preferably a sizable piece of stiff leather, but as previously mentioned with respect to the member 26 utilized on the rear of my device, the member 34 could be made of relatively stiff plastic if such for any reason be preferred.

It is to be understood that the front portion 24 of the strap member 20 could be a single piece of nylon webbing or the like, and I prefer for it to be in two pieces, with the inner end of each piece, that is, the ends not to be associated with the buckles, being secured to the member 34, such as by stitching. In this way the front portion 24 of the strap member 20 possesses substantial width, thus spreading the force of the tightened strap member over a greater number of square inches of the abdominal area of the user than would be achieved with belt only, i.e. without member 34. In addition, the use of the member 34 serves to maintain the waist-encircling member 12 in a non-slip manner at the desired location on the user's body. The member 34 preferably is not stitched or otherwise directly secured to the waist-encircling member 12.

Because, as previously mentioned, the rear portion 22 of the strap member 20 is firmly affixed to the rear of the waist-encircling member 12, the user can, after inserting end 30 of front belt portion 24 through buckle member 28, and end 31 through buckle member 29, grasp such ends and pull them tightly enough to snugly attach the front portion 24 of the strap 20 to the abdominal area of the user. FIG. 7 is a clear illustration of this aspect of my invention.

The front part of strap member 20 extends across the outer surface of the relatively stiff member 34 previously mentioned as being affixed to the front of the waist-encircling member 12. This portion of the strap member 20 is preferably covered, at least partially, with a laterally-extending strip or portion of loop-type VELCRO 35. This strip 35 of loop-type VELCRO extends for substantially the entire width of the member 34, and it forms a convenient location for the attachment of the free ends 30 and 31 of the front portion 24 of the strap member 20.

It is to be understood that the preferred arrangement involves the application of hook-type VELCRO on both of the free ends 30 and 31 of the front portion 24, with one of the free ends, such as end 31, also having loop-type VELCRO on the side of the strap opposite the hook-type VELCRO.

In use, the wearer would typically bring the hook-type VELCRO of end 31 into firm contact with the loop-type VELCRO 35 utilized on the front portion 34, at such time as that part of that strap has been pulled tightly. At this point the wearer pulls the opposite strap portion 30 tightly, and then folds the hook-type VELCRO on the inner surface of that strap portion down into contact with the loop-type VELCRO utilized on the exterior surface of the strap end 31. As an alternative, the hook-type VELCRO on the inner surface of strap portion 30 can be brought into contact with the loop-type VELCRO 35 utilized on the front portion 34. This completes the securing of the ends 30 and 31 of strap member 24 in a desirably tight fashion around the waist of the wearer.

It is to be understood that as previously mentioned, my novel elasticized garment or interconnection means 40 is to be secured to a rear portion of the waist-encircling member 12, for it is the purpose of my novel device to dispose the elastic means 40 on the rear side of the legs of the wearer or user, in the manner depicted in FIG. 2, with the attachment members 72 and 74 on the lowermost portions 42 and 44 of the elasticized means 40 being attached by the use of VELCRO to thigh-encircling members 52 and 54, respectively.

As mentioned hereinabove, I preferably dispose a length of loop-type VELCRO 36 along the rear side of the interior surface 14 of the waist-encircling member 12, in the manner shown in FIG. 1, in order to form the upper support for the upper portion 46 of the elasticized garment or interconnection means 40. This length of loop-type VELCRO resides in a symmetrical manner across the back interior portion of the waist-encircling member 12. Although this length of loop-type VELCRO 36 could be on the outside of the waist-encircling member 12, I prefer to utilize, as I mentioned hereinbefore, the loop-type VELCRO 36 across the rear interior surface 14 of the waist-encircling member 12.

The piece of loop-type VELCRO 36 is preferably disposed on the interior of the waist-encircling member 12 for several reasons, one being that this reduces the tendency of the waist-encircling member to distort out of the desired configuration. Also, by disposing the loop-type VELCRO on the interior of the waist-encircling member 12, the holding power of this arrangement is greatly enhanced. This is because the tightening of the strap member 20 in the manner depicted in FIG. 7 serves to hold the hook-type VELCRO 48 located along the upper edge or waist portion 46 of the elasticized garment or interconnection means 40 (see FIG. 3) in a very tight manner against the loop-type VELCRO 36 located on the interior of the waist-encircling member 12. Additionally, placing the upper portion of the elasticized garment 40 against the interior of the waist-encircling member 12 helps to fill in gaps that might otherwise occur between the interior of the waist-encircling member 12 and the user's back. The previously mentioned small, square piece of neoprene sheet rubber used to build up or make thicker the upper portion of the elastic interconnection means 40 also serves to fill in these gaps, providing more comfort and support to the user's back.

Inasmuch as the lower portions 42 and 44 of the elasticized garment or interconnection means 40 are to be brought into a secured relationship with the thigh-encircling members 52 and 54 as soon as the exercise period is to begin, the wearer should now concern himself or herself with attachment of the thigh-encircling members 52 and 54 around his or her thighs.

Each thigh-encircling member is preferably constructed of the same material as described hereinabove with respect to the waist-encircling member 12, namely involving material in which a neoprene surface or other relatively smooth surface is brought into contact with the thigh of the wearer, with the exterior surface of the thigh-encircling member being of a texture resembling that of loop-type VELCRO. For the purposes of this explanation, the construction of the thigh-encircling member 54 is essentially identical with the construction of the thigh-encircling member 52, except that one is, of course, the mirror image of the other.

For convenience, I will now describe only thigh-encircling member 54, and it is to be understood that the exterior surface of this member is made desirably stiff by sewing or otherwise attaching a sizable piece 56 of leather, plastic or the like to the member, thus to prevent undesirable "roll-over" of the thigh-encircling member 54. The outer surface of the leather, plastic or other such member is covered with material 58 having the quality of loop-type VELCRO, thus enabling each thigh-encircling member to be usable by people of widely varying thigh size.

By disposing a piece or patch 60 of hook-type VELCRO on the inner surface 62 of the free end of the thigh-encircling member 54 (or 52), the wearer, at the time of installation, can wrap the free end of the thigh-encircling member tightly about his or her thigh, and then press the patch 60 of hook-type VELCRO into firm contact with the material 58 covering the outer surface of the member 56 used to stiffen the outer surface of the thigh-encircling member. In this way the thigh-encircling member 54 is maintained in a sufficiently tight manner about the thigh of the user.

With reference now back to FIG. 4, it is to be seen that I prefer to utilize hook-type VELCRO on the attachment member 72 affixed to the lower portion 42 of the elasticized garment or interconnection means 40, and to utilize hook-type VELCRO on the attachment member 74 affixed to the lower portion 44 of the elastic interconnection means 40. This arrangement enables the user to readily secure the separate lower portions or ends of the elastic interconnection means 40 to the loop-type VELCRO utilized on the respective thigh-encircling members 52 and 54 as soon as the exercise period is to begin, this being shown in FIG. 2. On the other hand, the wearer or user can readily separate the ends of the elastic interconnection means 40 from the thigh-encircling members 52 and 54 whenever he or she desires to terminate the exercise period.

Although I prefer the construction wherein the elasticized garment 40 or interconnection means is attached in a removable manner to the waist-encircling member and to the respective thigh-encircling members, such as by the use of VELCRO or the like, it is within the spirit of my invention to utilize a unitary construction in which the elasticized garment is securely attached to the waist encircling member and to the thigh-encircling members.

It is therefore to be seen that I have provided a highly effective yet reasonably priced multicomponent exercise device that can be readily used by a person desiring exercise, without requiring that person to put on a complicated or bulky exercise suit. As a matter of fact, one of the most important features of my invention is the fact that the person desiring exercise can readily put on the components needed in order to receive my novel elasticized garment or interconnection means designed to extend the waist and the thighs of the user. Manifestly, the user need not change his or her clothes, but can even install the components of my novel exercise device directly over the clothes that the user wore to the office. After such installation, the person can then go about his or her normal activities of walking, performing chores or the like, without finding my novel device in any way obtrusive, but with this device nevertheless providing a desirable amount of muscle exercise. Because the interior surface 14 of the waist-encircling member is smooth, it does not in any manner adhere to the clothing the user is wearing.

I claim:

1. An elasticized garment intended to provide exercise to the upper legs, hips, buttocks and abdominal muscles of a wearer, said garment being generally in an inverted, U-shaped configuration, with an upper portion of said elasticized garment to be attached to a rear waist portion of the wearer, said garment including a pair of elasticized descending members having upper and lower ends, to which upper portion of said garment, the upper ends of said pair of elasticized descending members are firmly attached, the lower end of each of said elasticized descending members having attachment means for attachment on the rear side of an upper leg portion of the wearer, said elasticized descending members utilizing a plurality of wide elastic sheets designed when in use to reside against the buttocks of the wearer, and because of their width, to provide substantial exercise to extensive portions of the buttocks, said elasticized descending members also serving to resist the wearer's forward leg motion, and thus provide a selected amount of exercise to the wearer during walking or running.

2. The elasticized garment intended to provide exercise to the upper legs, hips, buttocks and abdominal muscles of a wearer as recited in claim 1 in which hook and loop strips serve as a means for removably attaching said upper portion of said elasticized garment to the rear waist portion and to the upper leg portions of the wearer.

3. The elasticized garment intended to provide exercise to the upper legs, hips, buttocks and abdominal muscles of a wearer as recited in claim 1 in which said elasticized garment is utilized in combination with a waist-encircling member, said waist-encircling member having a rear waist portion, said upper portion of said elasticized garment having means for ready attachment to said rear waist portion of said waist-encircling member.

4. The elasticized garment intended to provide exercise to the upper legs, hips, buttocks and abdominal muscles of a wearer as recited in claim 3 in which hook and loop strips serve as said means for ready attachment of said upper portion of said elasticized garment to said rear waist portion of said waist-encircling member.

5. The elasticized garment intended to provide exercise to the upper legs, hips, buttocks and abdominal muscles of a wearer as recited in claim 4 in which a plurality of locations are defined on said rear waist portion, for receiving said upper portion of said elasticized garment, thus providing a means for determining the degree of stretch of said elasticized descending members during use by the wearer.

6. The elasticized garment intended to provide exercise to the upper legs, hips, buttocks and abdominal muscles of a wearer as recited in claim 3 in which hook and loop strips serve for attaching said lower end of each of said elasticized descending members to respective upper leg portions of the wearer.

7. The elasticized garment intended to provide exercise to the upper legs, hips, buttocks and abdominal muscles of a wearer as recited in claim 6 in which said garment is utilized in combination with a pair of leg-encircling members, which the wearer may attach around the lower thighs, just above the knee, each of said leg-encircling members having attachment means thereon, for removably receiving said lower ends of said elasticized descending members.

8. The elasticized garment intended to provide exercise to the upper legs, hips, buttocks and abdominal muscles of a wearer as recited in claim 7 in which a plurality of attachment means locations are defined on said leg-encircling members, thus providing a means for determining the degree of stretch of said elasticized descending members during use by the wearer.

9. The elasticized garment intended to provide exercise to the upper legs, hips, buttocks and abdominal muscles of a wearer as recited in claim 3 in which said waist-encircling member further utilizes a partially attached strap, capable of being independently tightened, which strap can be selectively utilized for applying an additional tightening force around the wearer's waist.

10. The elasticized garment intended to provide exercise to the upper legs, hips, buttocks and abdominal muscles of a wearer as recited in claim 3 in which said elasticized descending members comprise a plurality of wide elastic sheets designed when in use to reside against the buttocks of the wearer, and provide substantial exercise thereto.

11. The elasticized garment intended to provide exercise to the upper legs, hips, buttocks and abdominal muscles of a wearer as recited in claim 1 in which said wide elastic sheets are approximately four inches wide.

12. An elasticized garment for providing exercise to the legs and hips of a wearer during walking or running, said garment comprising an upper portion having attachment means enabling said upper portion to be removably attached at a rear waist portion of the wearer, as well as separate, elongate lower portions attached to said upper portion, said elongate lower portions being made of elasticized material and having means on their lowermost ends for removable attachment to upper rear leg portions of the wearer, said elasticized elongate lower portions utilizing a plurality of wide elastic sheets designed when in use to reside against the buttocks of the wearer, and because of their width, to provide substantial exercise to extensive portions of the buttocks, said elasticized descending members being normally stretched between the waist portion of the wearer and the upper rear leg portions so as to resist the wearer's forward leg motion.

13. The elasticized garment for providing exercise to the legs and hips of a wearer during walking or running as recited in claim 12 in which said garment is utilized in combination with a pair of leg-encircling members, which the wearer may attach around the lower thighs, just above the knee, each of said leg-encircling members having attachment means thereon, for removably receiving said lowermost ends of said elasticized elongate lower portions.

14. The elasticized garment for providing exercise to the legs and hips of a wearer during walking or running as recited in claim 13 in which a plurality of attachment locations are utilized on each of said leg-encircling members, thus making it possible for the wearer to determine the degree of stretch of each of said elasticized elongate lower portions.

15. The elasticized garment for providing exercise to the legs and hips of a wearer during walking or running as recited in claim 14 in which hook and loop strips serve as said attachment means on said leg-encircling members.

16. The elasticized garment for providing exercise to the legs and hips of a wearer during walking or running as recited in claim 12 in which the rear waist portion of the wearer comprises a waist-encircling member.

17. The elasticized garment for providing exercise to the legs and hips of a wearer during walking or running as recited in claim 16 in which said waist-encircling member further utilizes a partially attached strap, capable of being independently tightened, which strap can be selectively utilized for applying an additional tightening force around the wearer's waist.

18. The elasticized garment for providing exercise to the legs and hips of a wearer as recited in claim 12 in which said wide elastic sheets are approximately four inches wide.

19. A multicomponent device to be worn around the waist and thighs to provide exercise to the thighs, buttocks and abdominal muscles of a wearer, one of said components being a waist-encircling member having tightening means enabling it to be worn tightly around the waist of the wearer in a substantially non-slip fashion, said device also including a pair of thigh-encircling members, each of said thigh-encircling members having a respective tightening means, so that each may be firmly attached around a respective thigh of the wearer, just above the knee, and elongate elastic interconnection means for use in interconnecting said waist-encircling member with said thigh-encircling members, said elastic interconnection means utilizing a plurality of wide elastic sheets designed when in use to reside against the buttocks of the wearer, and because of their width to provide substantial exercise to extensive portions of the buttocks, said elasticized descending members having an upper portion, and a pair of separate lower portions, said upper portion of said elastic interconnection means being attached to a rear portion of said waist-encircling member, with each of said lower portions of said elongate elastic interconnection means being attached to a respective thigh-encircling member, the presence of said elastic interconnection means extending between said waist-encircling member and said thigh-encircling members providing a selected amount of resistance to the use of certain leg muscles of the wearer in order for the wearer to be able to walk or run.

20. The multicomponent device to be worn around the waist and thighs to provide exercise to the thighs, buttocks and abdominal muscles of a wearer as recited in claim 19 in which said waist-encircling member further utilizes a partially attached strap, capable of being independently tightened, which strap can be selectively utilized for applying an additional tightening force around the wearer's waist.

21. The elasticized garment for providing exercise to the legs and hips of a wearer as recited in claim 19 in which said wide elastic sheets are approximately four inches wide.

22. The multicomponent device to be worn around the waist and thighs to provide exercise to the thighs, buttocks and abdominal muscles of a wearer as recited in claim 19 in which said elastic interconnection means is removably attached to said waist-encircling member and said thigh-encircling members by the use of hook and loop strips.

23. The multicomponent device to be worn around the waist and thighs to provide exercise to the thighs, buttocks and abdominal muscles of a wearer as recited in claim 19 in which said waist-encircling member and said thigh-encircling members are of unitary construction with said elastic interconnection means.

* * * * *